US007922100B2

(12) United States Patent
Deligiannis

(10) Patent No.: US 7,922,100 B2
(45) Date of Patent: Apr. 12, 2011

(54) GROUND WIRE ADAPTOR

(75) Inventor: Jorge Deligiannis, Ottawa (CA)

(73) Assignee: Energate Inc., Ottawa, ON (CA)

( * ) Notice: Subject to any disclaimer, the term of this patent is extended or adjusted under 35 U.S.C. 154(b) by 569 days.

(21) Appl. No.: 12/047,316

(22) Filed: Mar. 12, 2008

(65) Prior Publication Data

US 2009/0234505 A1 Sep. 17, 2009

(51) Int. Cl.
*G05D 23/00* (2006.01)

(52) U.S. Cl. ..... 236/1 C; 439/105; 439/108

(58) Field of Classification Search ..... 236/1 C; 439/105, 108; 340/584; 700/276
See application file for complete search history.

(56) References Cited

U.S. PATENT DOCUMENTS 3,815,668 A 6/1974 Carlson
4,007,458 A 2/1977 Hollabaugh
4,131,882 A 12/1978 Hollabaugh
4,222,035 A 9/1980 Lohoff
4,889,179 A 12/1989 Merenda
4,990,908 A 2/1991 Tung
7,538,297 B2 * 5/2009 Anderson et al. ..... 219/260
2009/0209128 A1 * 8/2009 Mullin ..... 439/502

* cited by examiner

*Primary Examiner* — Marc E Norman
(74) *Attorney, Agent, or Firm* — Gowling Lafleur Henderson LLP

(57) ABSTRACT

A ground wire adaptor for operatively connecting a low-voltage control unit (e.g. a thermostat) requiring a three-wire connection to a three-wire system-under-control (e.g. a HVAC system) using a two-wire conductor. A ground terminal and an output control signal of the control unit are interconnected such that the output control signal, in the form of a half-wave rectified signal, is superimposed on the ground. The ground wire adaptor detects the half-wave rectified signal superimposed on the ground connection and generates a control output signal to be provided to the system-under-control responsive to the presence of the half-wave rectified signal (i.e. the control signal from the control unit). In another aspect of the invention the ground wire adaptor can be used to connect an 'N' function control unit to an 'N' function system-under-control using a two-wire conductor.

5 Claims, 4 Drawing Sheets

GROUND WIRE ADAPTOR

FIELD OF INVENTION

The present invention relates to the field of low-voltage control systems. In particular, to a ground wire adaptor for use in a low-voltage control system.

BACKGROUND

The use of low-voltage (e.g. less than equal 48V) control systems to operate domestic heating, ventilation and air conditioning (HVAC) systems is common. FIG. 1 is a schematic representation of a typical prior art two-wire control system 100. In their simplest form these control systems historically have consisted of a low-voltage alternating cycle (AC) source 105 (e.g. a transformer) located proximate to a HVAC component 110 (e.g. a furnace), a control unit 115 (e.g. a thermostat) located in the living area of a home and a two-wire conductor 120 interconnecting the transformer 105, the thermostat 115 and the furnace 110. The conductor 120 is arranged to supply AC current from the transformer 105 to the thermostat 115 via a first wire 122. The thermostat 115 switches the AC current typically using mechanical means 125 (e.g. a mercury bulb switch). The switched output of the thermostat 115 is connected via a second wire 124 to the furnace 110 to provide control (i.e. to signal a demand for heat). A current return path is provided between the furnace 110 and the transformer 105.

With the advancement of electronics technology and a desire for greater energy efficiency, the analog thermostats having mechanical switching means are being replaced by digital thermostats some of which include solid-state switching means. Where it is desired to replace an analog thermostat with a digital thermostat in a home having a two-wire conductor as described above, an issue exists with regard to providing a ground reference for the digital thermostat. Normally when no heat is being demanded the output of the thermostat would be in an open circuit state and therefore no current return path to the transformer would exist to provide a ground reference for the thermostat.

Manufactures of digital thermostats have typically addressed the lack of ground reference using one of two approaches. The first approach is to provide the digital thermostat with an independent power source (e.g. disposable dry-cell batteries) that powers the control logic and only switching the AC current for control signal purposes. This solution is not desirable in some situations (e.g. when the home is unattended for long periods of time) as a failure of the independent power source (e.g. when the batteries are discharged) causes failure of the thermostat. The second approach is to require that the two-wire be replaced (or alternatively supplemented) with a conductor having at least three wires. In some situations replacing the conductor is not practical or is too costly. In particular, replacement of the conductor is not a viable alternative when a replacement thermostat is being marketed to a homeowner who wants to do the installation himself.

Another related issue arises when additional HVAC equipment (e.g. heat-pump, air conditioning, humidifier) as added to existing HVAC equipment and the thermostat is replaced with a new thermostat having additional control capability for the added equipment. Typically at least one independent wire is required for each piece of equipment in addition to one wire for supplying AC current. In existing homes the existing conductor, even when it contain more than two wires, may not have sufficient independent wires for all of the equipment.

One solution is to replace (or supplement) the existing conductor but, as discussed above, in some situations replacing the conductor is not practical or is too costly.

What is needed is a mechanism to allow the use of a low-voltage control unit (e.g. thermostat) requiring at least a given number ('N') of independent connections (i.e. wires), to control one or more pieces of equipment, with an interconnecting conductor having less than 'N' wires.

SUMMARY OF INVENTION

A ground wire adaptor for operatively connecting a low-voltage control unit (e.g. a thermostat) requiring a three-wire connection to a three-wire system-under-control (e.g. a HVAC system) using a two-wire conductor. A ground terminal and an output control signal of the control unit are interconnected such that the output control signal, in the form of a half-wave rectified signal, is superimposed on the ground. The ground wire adaptor detects the half-wave rectified signal superimposed on the ground connection and generates a control output signal to be provided to the system-under-control responsive to the presence of the half-wave rectified signal (i.e. the control signal from the control unit). In another aspect of the invention the ground wire adaptor can be used to connect an 'N' function control unit to an 'N' function system-under-control using a two-wire conductor.

In accordance with one aspect of the present invention, there is provided a ground wire adaptor for connecting an environmental control, having a power terminal, a ground terminal, a control output terminal and a conductive element connected between the ground terminal and the control output terminal, to a heating/ventilating/air-conditioning (HVAC) equipment, having a first transformer output terminal, a second transformer output terminal and a control input terminal, via a two wire conductor, having a first wire and a second wire, the ground wire adaptor comprising: a first transformer input terminal connected to the first transformer output terminal for receiving a low-voltage alternating current and connected to the power terminal via the first wire; a second transformer input terminal connected to the second transformer output terminal for providing a ground return path; an EC terminal connected to the ground terminal via the second wire for providing a ground path; an asymmetrically-resistive electrical network connected between the EC terminal and the second transformer input terminal, providing a relatively lower resistance to current flow from the EC terminal to the second transformer input terminal and a relatively higher resistance to current flow from the second transformer input terminal to the EC terminal, for providing ground path continuity; a HE terminal connected to the control input terminal for providing a control signal; a control logic unit for sensing voltage on the EC terminal and responsive to detecting a negative half-cycle providing a control signal; a switching device for connecting, responsive to the control signal from the control logic unit, the first transformer terminal to the HE terminal to provide the control signal to the HVAC equipment; wherein a low-voltage alternating current half-cycle control signal is provided at the control output terminal of the environmental control when a function is being demanded and further wherein responsive to a control signal at the control input terminal, the HVAC equipment provides the demanded function.

In accordance with another aspect of the present invention, there is provided a ground wire adaptor for providing a plurality of control signals to a heating/ventilating/air-conditioning (HVAC) equipment, having a first transformer output terminal, a second transformer output terminal and a plurality of control input terminals, and for connecting to both ends of a two wire conductor, having a first wire and a second wire, connecting a first location and a second location, the ground wire adaptor comprising: a multi-function environmental control, at the first location, having: a power terminal connected to the first wire for receiving a low-voltage alternating current; an output terminal connected to the second wire for establishing a ground reference for the multi-function environmental control; a control logic unit for continuously generating a control bit stream having repeated frames of N+1 bits, a first synchronizing bit of each successive frame alternating between values '0' and '1', each of the subsequent N bits in each frame taking on a value '1' when a corresponding HVAC equipment function is being demanded and taking on a valve '0' when the corresponding HVAC equipment function is not being demanded; and a switching device connected between the power terminal and the output terminal for receiving the control bit stream and responsive to each bit in the bit stream operating into a non-conductive mode when the bit has value '0' and operating into a conductive mode when the bit has value '1' thereby generating a control signal at the output terminal; and an adaptor module, at the second location, having: a first transformer input terminal connected to the first transformer output terminal for receiving a low-voltage alternating current and connected to the power terminal via the first wire; a second transformer input terminal connected to the second transformer output terminal for providing a ground return path; a EC terminal connected to the output terminal via the second wire for providing a ground path and for receiving the control signal; an asymmetrically-resistive electrical network connected between the EC terminal and the second transformer input terminal, providing a relatively lower resistance to current flow from the EC terminal to the second transformer input terminal and a relatively higher resistance to current flow from the second transformer input terminal to the EC terminal, for providing ground path continuity; a plurality of HE terminals, each connected to a corresponding control input terminals; a plurality of switching devices each one for connecting the first transformer terminal to a corresponding HE terminal responsive to a function control signal; a control logic unit for sensing voltage on the EC terminal and for: detecting the presence or absence of negative half-cycles and associating a '0' value with the absence of a negative half-cycle and associating a '1' value with the presence of a negative half-cycle; detecting successive frames by identifying the synchronizing bit and associating each of the subsequent N bits in each frame with a corresponding function control signal; asserting a function control signal to each of the switching devices to enter a conductive mode of operation when the corresponding function control signal has value '1'; and de-asserting the function control signal to each of the switching devices to enter the conductive mode of operation when the corresponding function control signal has value '0'; wherein a function control signal is provided at each of the HE terminals of the adaptor module when a corresponding function is being demanded and wherein, responsive to the function control signal at the corresponding control input terminal, the HVAC equipment provides the demanded corresponding function.

Other aspects and features of the present invention will become apparent to those ordinarily skilled in the art or science to which it pertains upon review of the following description of specific embodiments of the invention in conjunction with the accompanying figures.

BRIEF DESCRIPTION OF DRAWINGS

The present invention will be described in conjunction with drawings in which.

DETAILED DESCRIPTION

Figure 1:
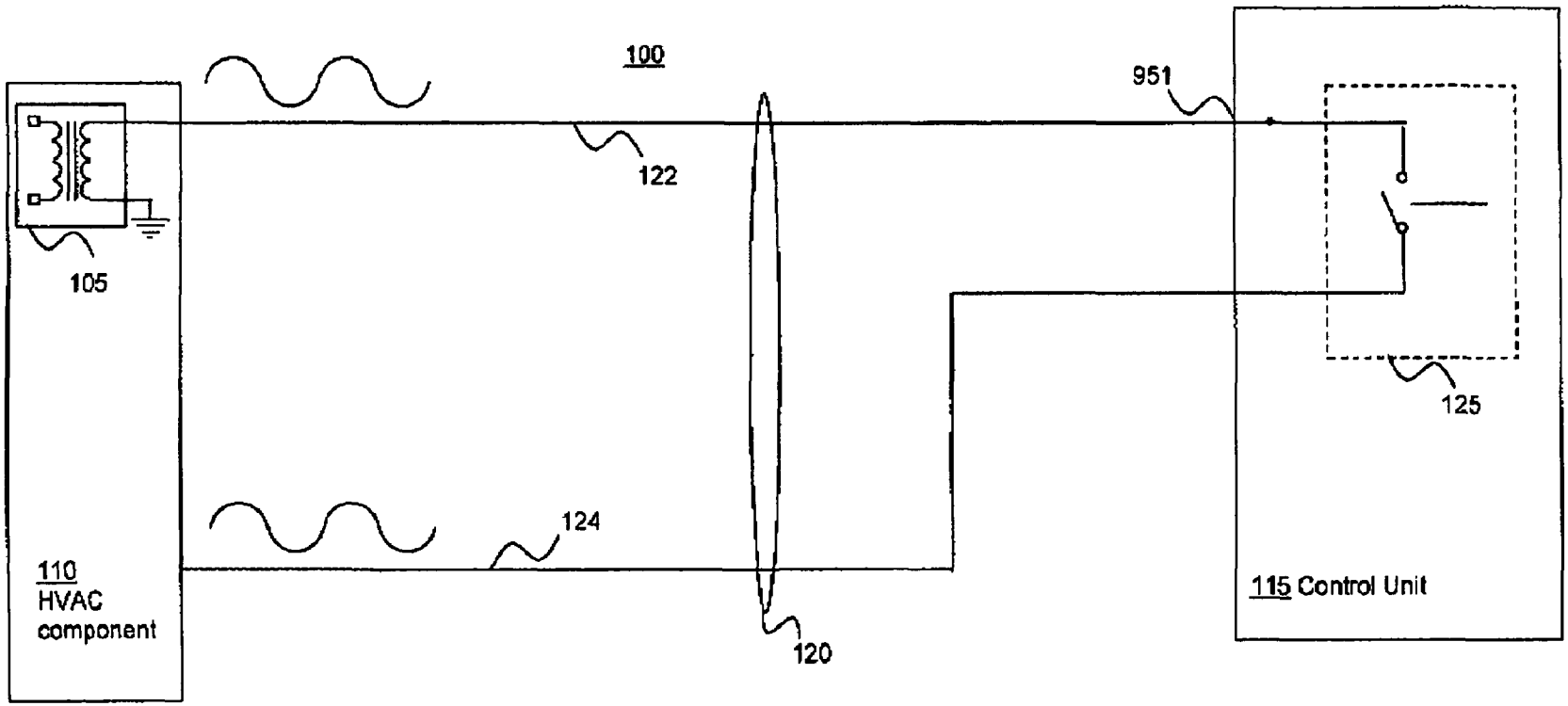
Figure 1 PRIOR ART
FIG. 1 is a schematic representation of a typical prior art two-wire control system.
Figure 2:
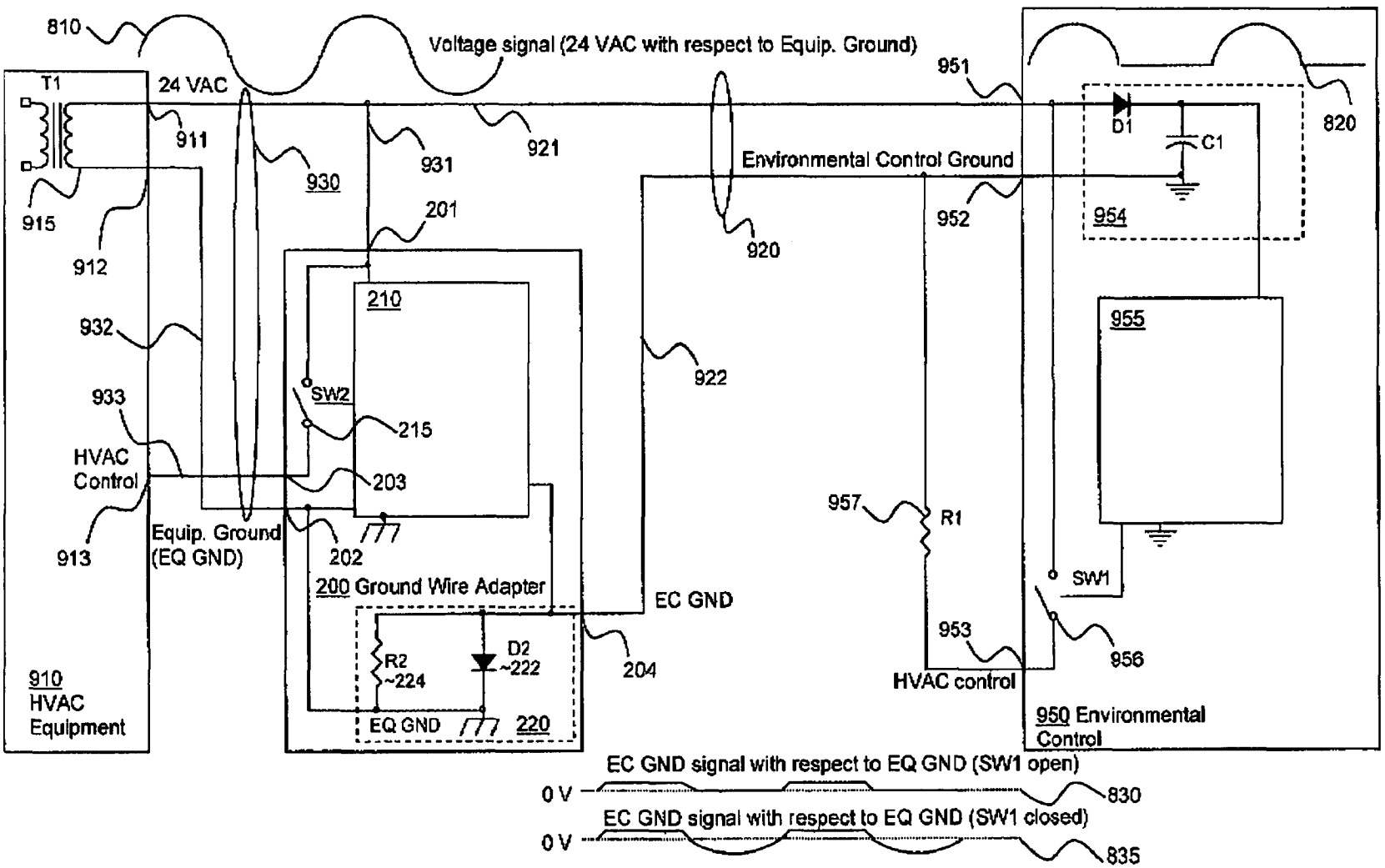
FIG. 2 is a schematic representation of an exemplary ground wire adaptor in an exemplary environment in which it can be used.

FIG. 2 is a schematic representation of an exemplary ground wire adaptor 200 in an exemplary environment in which it can be used. The ground wire adaptor 200 can be used in conjunction with HVAC equipment 910 and an environmental control 950. The HVAC equipment 910 can be any of the well know HVAC equipment types such as, for example, a furnace (i.e. a heating system), an air conditioning unit, a heat pump and combinations of these and similar devices that are controllable using switched low-voltage (e.g. less than or equal 48V) control circuits. The environmental control 950 can be any of the well know environmental control unit types such as, for example, a thermostat, a humidistat or other similar device that provides control of the HVAC equipment 910 by switching a low-voltage control circuit.

The environmental control 950 has three connection terminals: a power terminal 951, a ground terminal 952, and a control output terminal 953. The environmental control 950 provides a low-voltage signal from the control output terminal 953 when the HVAC equipment 910 is to be activated (e.g. when heat is demanded). The environmental control 950 further has a half-wave rectifier 954, a control logic unit 955 and a switching device 956. The output of the half-wave rectifier 954 is used to power the control logic unit 955. The switching device 956 provides switching between the power terminal 951 and the control output terminal 953 responsive to a control signal from the control logic unit 955. The switching device 956 can be any well-known power switching device such as, for example, a mechanical relay or a solid-state switching device.

The HVAC equipment 910 includes a transformer 915 that provides a low-voltage AC output current. The HVAC equipment 910 has three connection terminals: a first transformer terminal 911, a second transformer terminal 912, and a control input terminal 913. The HVAC equipment 910 is activated (e.g. begins generating heat) when a low-voltage signal is applied to the control input terminal 913. In an alternative configuration (not illustrated), the transformer 915 can be independent of the HVAC equipment 910 and terminals 911 and 912 are connected to the respective terminals of the transformer 915.

The ground wire adaptor 200 comprises a control logic unit 210, a switching device 215, an environmental control (EC) terminal 204, an HVAC equipment (HE) terminal 203, a first transformer terminal 201, a second transformer terminal 202, and an asymmetrically-resistive electrical network 220. The switching device 215 provides switching between the first transformer terminal 201 and the HE terminal 203 responsive to a control signal from the control logic unit 210. The switching device 215 can be any well-known power switching device such as, for example, a mechanical relay or a solid-state switching device. The asymmetrically-resistive electrical network 220 comprises a diode 222 (i.e. a rectifier) and a resistor 224 connected in parallel between the EC terminal 204 and the second transformer terminal 202 for providing a current return path for the environmental control 950 and a ground reference to second terminal 912 of the transformer 915. The asymmetrically-resistive electrical network 220 has a substantially zero resistance to current flowing from EC terminal 204 to the second transformer terminal 202 as the current flows through the diode 222 and a relatively higher resistance to current flow in the opposite direction as the current flows through resistor 224. Current flow in the opposite direction (i.e. from the second transformer terminal 202 to the EC terminal 204) results in a negative voltage, measured from EC terminal 204 to second transformer terminal 202, that is proportional to the magnitude of the current flow. The control logic unit 210 applies a voltage sensing function to a signal on the EC terminal 204 and, responsive to the signal, provides a control signal to drive open or closed the switching device 215.

A two-wire conductor 920, having a first wire 921 and a second wire 922, interconnects the environmental control 950 and the ground wire adaptor 200. The two-wire conductor 920 can be a pre-existing conductor from the location of the environmental control 950 (typically in a living area of a home) to the location of the HVAC equipment 910 with the ground wire adaptor 200 being co-located with the HVAC equipment 910. In an alternative embodiment the ground wire adaptor 200 can be located proximate an end of the two-wire conductor distal from the environmental control 950 and the HVAC equipment can be non-co-located with the ground wire adaptor 200 (i.e. can be elsewhere). The first wire 921 interconnects the power terminal 951 with the first transformer terminal 201 and the second wire 922 interconnects the ground terminal 952 and the EC terminal 204 respectively of the environmental control 950 and the ground wire adaptor 200. A resistor 957 interconnects the ground terminal 952 and the control output terminal 953 of the environmental control 950. In an alternative arrangement (not illustrated) an active device such as, for example, a transistor can be used to interconnect the ground terminal 952 and the control output terminal 953 of the environmental control 950 replacing resistor 957. The transistor and associated passive components (e.g. providing transistor drive and switching-current limiting) can be incorporated into the environmental control 950.

A three-wire conductor 930, having a first wire 931, a second wire 932 and a third wire 933, interconnects the ground wire adaptor 200 and the HVAC equipment 910. The first wire 931 interconnects the first transformer terminal 201 and the first transformer terminal 911 of respectively the ground wire adaptor 200 and the HVAC equipment 910. The second wire 932 interconnects the second transformer terminal 202 and the second transformer terminal 912 of respectively the ground wire adaptor 200 and the HVAC equipment 910. The third wire 933 interconnects the HE terminal 203 and the control input terminal 913 of respectively the ground wire adaptor 200 and the HVAC equipment 910. In an alternative configuration the first wire 931, a second wire 932 and a third wire 933 can be independent conductors not arranged in the three-wire conductor 930 but still interconnected as described earlier in this paragraph and proving equivalent function.

Waveform 810 illustrates an exemplary substantially sinusoidal voltage signal output by the transformer 915 and received at the power terminal 951. Waveform 810 enters the rectifier 954 and waveform 820 containing only positive half-cycles results and is provided to the control logic unit 955.

Waveform 830 illustrates a voltage signal output at the ground terminal 952 and received at the EC terminal 204 when switching device 956 is in an open (i.e. off) mode of operation. Waveform 830 comprises a substantially zero (0) voltage signal superimposed with positive half-cycles of substantially minor voltage magnitude compared to the voltage output by the transformer 915. The positive half-cycles have a voltage magnitude substantially equal to the forward voltage drop of diode 222 (typically less than 1 V).

Waveform 835 illustrates a voltage signal output at the ground terminal 952 and received at the EC terminal 204 when switching device 956 is in a conductive (i.e. on) mode of operation. Waveform 835 comprises positive half-cycles of substantially minor voltage magnitude (e.g. less than 1 V) compared to the voltage output by the transformer 915 and negative half-cycles of more significant voltage magnitude. The amplitude ratio between the negative peak voltage at EC terminal 204 and the corresponding peak at the transformer 915 is substantially equal to the ratio of the resistance of resistor 224 to the resistance of resistor 957. For example, when resistor 224 has a resistance value of 2 kΩ and resistor 957 has a resistance value of 10 kΩ, the ratio is 1/5. In the same example, when the transformer 915 has an output of 24 VAC RMS (i.e. approximately 33.94 V peak) the negative peak at the EC terminal 204 is substantially 6.79 V (i.e. 33.94 V/5). The control logic unit 210 uses a voltage sensing mechanism to differentiate between waveform 830 and waveform 835. The voltage sensing mechanism can, for example, comprise a resistor divider connected between the EC terminal 204 and a reference voltage from an analog to digital (A/D) converter included in the control logic unit 210, wherein the output of the resistor divider is sampled by the A/D converter input. Alternatively the voltage sensing mechanism can comprise any well-known analog circuit including an operational amplifier or voltage comparator arranged for comparing a voltage to a reference voltage level. When waveform 830 is detected, switching device 215 is driven into the open (i.e. off) mode of operation resulting in no demand for the HVAC equipment 910. When waveform 835 is detected, switching device 215 is driven into the conductive (i.e. on) mode of operation resulting in a waveform similar to 810 being presented at control input terminal 913 signifying a demand for the HVAC equipment 910 to operate. The ground wire adaptor 200 embodiment of FIG. 2 provides for an environmental control 950 having one control output to be operatively connected to a two wire voltage supply (i.e. the transformer 915) and to a HVAC equipment 910 having a control input, using only two wires while providing a ground reference to the control unit 950 even when the control output of the environmental control 950 is not asserting a demand for operation of the HVAC equipment 910.

Figure 3:
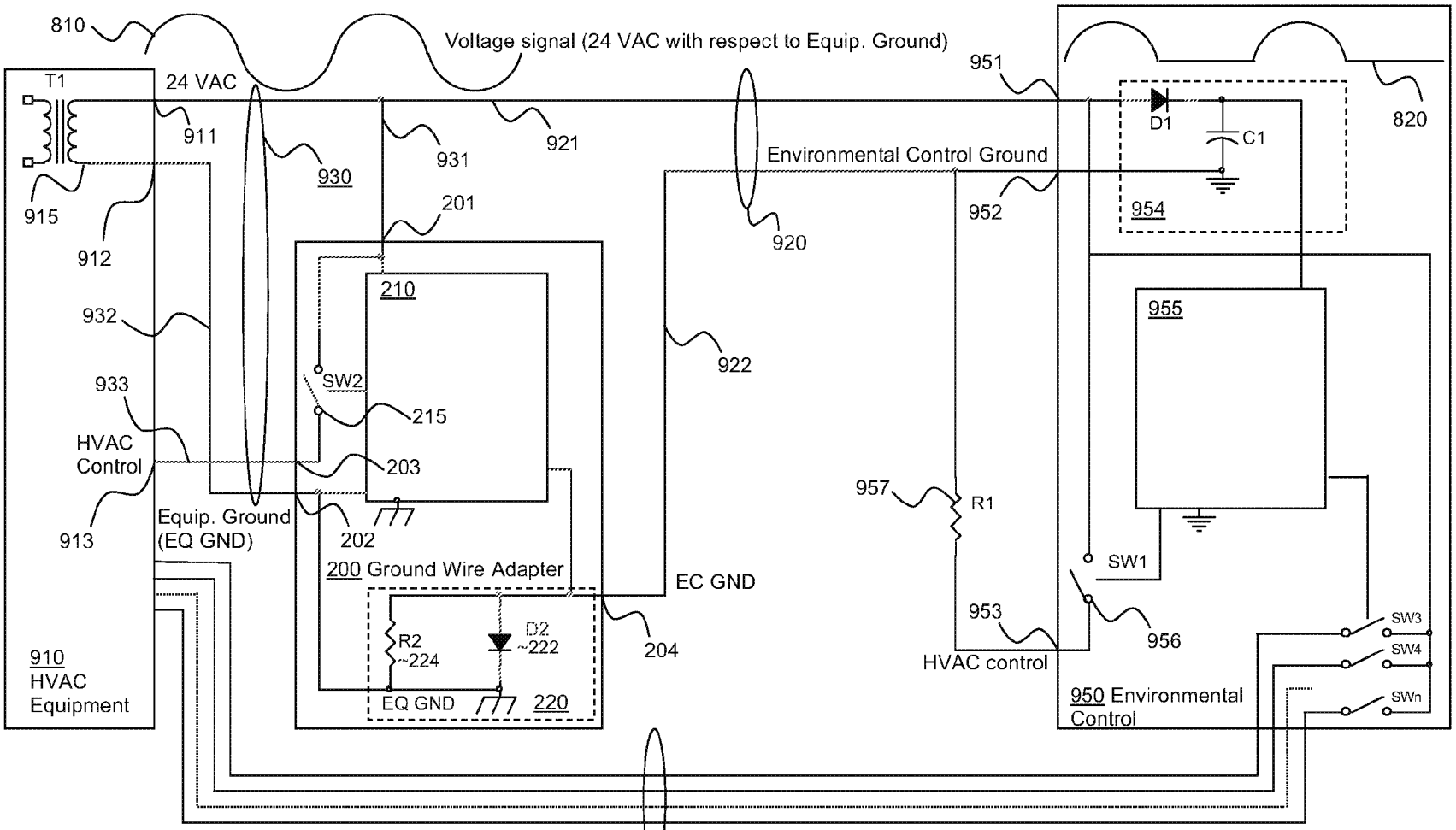
FIG. 3 is a schematic representation of an exemplary ground wire adaptor in an alternative environment in which it can be used.

FIG. 3 is a schematic representation of the exemplary ground wire adaptor 200 in an alternative environment in which it can be used. In the alternative environment the HVAC equipment 910 has multiple ('N') input control signal terminals, each one for receiving a control signal for a separate function (e.g. heat, cool, fan) in the HVAC equipment 910. The environmental control 950 has a corresponding number ('N') of switching devices for providing corresponding control signals to the HVAC equipment 910. The ground wire adaptor 200 is connected and operates in the same way as described above with reference to FIG. 2 to provide a first control signal from the environmental control 950 to the HVAC equipment 910 and to provide a ground reference to the environmental control 950. The remaining control signals (i.e. 2 through N) are provided by interconnecting each of the remaining (i.e. 2 through N) switching devices in the environmental control 950 to a corresponding input control signal terminals on the HVAC equipment 910 using individual wires for each signal. The ground wire adaptor 200 embodiment of FIG. 3 provides for an environmental control 950 having N separate control output to be operatively connected to a two wire voltage supply (i.e. the transformer) and to an N input HVAC equipment 910 using only N+1 wires while providing a ground reference to the control unit 950 even when the control output of the environmental control 950 is not asserting a demand for operation of the HVAC equipment 910.

Figure 4:
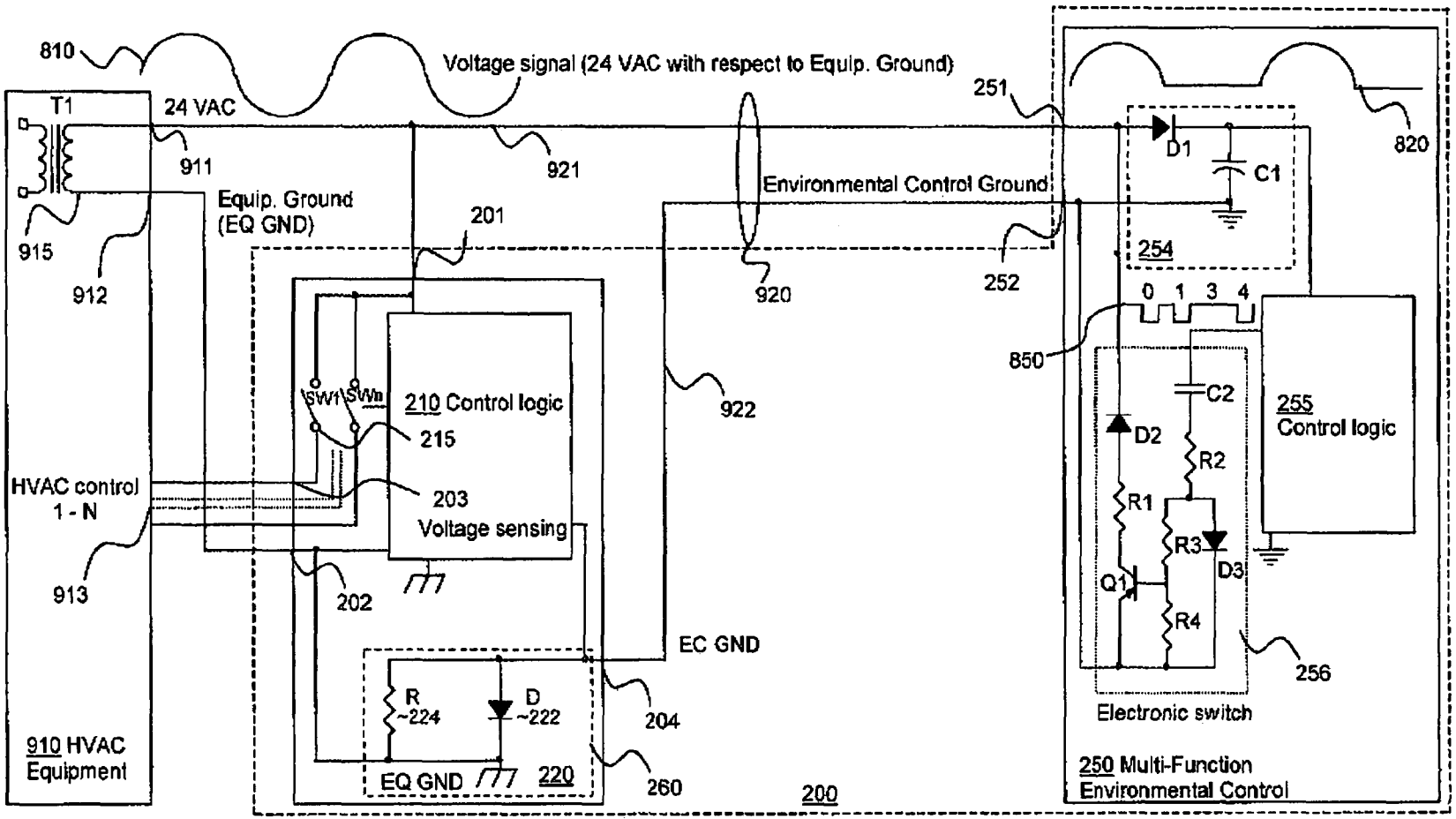
FIG. 4 is a schematic representation of an alternative exemplary ground wire adaptor in an exemplary environment in which it can be used.
Figure 4:
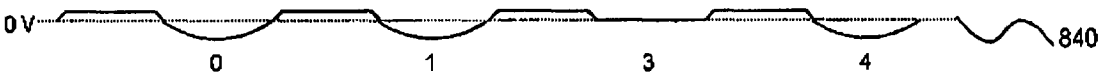

FIG. 4 is a schematic representation of an alternative exemplary embodiment of the ground wire adaptor 200 in an exemplary environment in which it can be used. An HVAC equipment 910 has multiple (numbered '1' through 'N') input control signal terminals 913, each one for receiving a control signal for a separate function (e.g. heat, cool, fan) in the HVAC equipment 910. The alternative embodiment of the ground wire adaptor 200 comprises an adaptor module 260 and a multi-function environmental control 250. The multi-function environmental control 250 provides for the encoding of a controls signal for each of the '1' through 'N' functions of the HVAC equipment 910 based on parameters, including sensed environmental parameters (e.g. temperature and humidity), and can be located distal (i.e. remote) from the adaptor module 260. The adaptor module 260 provides similar functions and comprises components substantially as described above with reference to the ground wire adaptor 200 and FIG. 2 except as otherwise specified below.

The multi-function environmental control 250 has two connection terminals: a power terminal 251 and a control output terminal 252. A two-wire conductor 920, having a first wire 921 and a second wire 922, interconnects the environmental control 250 and the adaptor module 260. The two-wire conductor 920 can be a pre-existing conductor from the location of the multi-function environmental control 250 (typically in a living area of a home) to the location of the adaptor module 260, with the adaptor module 260 typically being co-located with the HVAC equipment 910. The first wire 921 interconnects the power terminal 251 with the first transformer terminal 201 and the second wire 922 interconnects the control output terminal 252 and the EC terminal 204 respectively of the multi-function environmental control 250 and the adaptor module 260.

The multi-function environmental control 250 further comprises a half-wave rectifier 254, a control logic unit 255 and a switching device 256. The output of the half-wave rectifier 254 is used to power the control logic unit 255. The multi-function environmental control 250 uses the control output terminal 252 to establish a ground reference and further provides a low-voltage signal from the control output terminal 252 when any of the N functions of the HVAC equipment 910 are to be activated (e.g. when heating, cooling or the fan is demanded). Waveform 840 illustrates an exemplary voltage signal at the control output terminal 252 and received at the EC terminal 204. The waveform 840 consists of positive half-cycles of substantially minor voltage magnitude compared to the voltage output by the transformer 915 interspersed between each of one of a train of N+1 negative half-cycles numbered '0' through 'N'. The $0^{th}$ negative half-cycle is a synchronizing (i.e. framing) bit that alternates between a substantially zero (0) voltage value and a more significant voltage magnitude (hereinafter referred to as values '0' and '1' respectively). Each of the remaining negative half-cycles (1 through N) in the train independently take on a value of '0' or '1' responsive to the control logic unit 255 demanding the corresponding function in the HVAC equipment. The train of N+1 negative half-cycles (and the corresponding interspersed positive half-cycles) is repeated continually, one train after another. The train of negative half-cycles is generated by switching device 256 being driven alternately between an open and a conductive mode of operation responsive to a control signal received from the control logic unit 255. Waveform 850 illustrates an exemplary control signal from the control logic unit 255 to the switching device 256. The control signal can, for example, be a serial digital bit stream.

The adaptor module 260 comprises a control unit 210, an asymmetrically-resistive electrical network 220, and a plurality of switching devices 215 each one corresponding to one of the N HVAC equipment 910 functions, an environmental control (EC) terminal 204, a plurality of HVAC equipment (HE) terminals 203, a first transformer terminal 201, and a second transformer terminal 202. Control logic unit 210 decodes the waveform 840 to extract N individual HVAC function demand control signals. The control logic unit 210 synchronizes (i.e. frames) the train of half-cycles in waveform 840 using the synchronizing bit (i.e. the $0^{th}$ half-cycle). The synchronizing bit is identified by the fact that it alternates between values '0' and '1' with each successive train while the other (1 through N) half-cycles tend to remain in one value or the other for longer periods of time as they represent HVAC equipment 910 function demands. When the synchronizing bit has been identified, the individual function demand control signals (1 through N) can be derived from the subsequent N consecutive negative half-cycles. The logic control unit 210 can alternately drive open or conductive (i.e. off or on) each of the corresponding switching devices 215 responsive to the corresponding HVAC function demand control signals (1 through N). In a preferred embodiment, for each function demand control signal (1 through N) the logic control unit 210 can wait until the function demand control signal is found to have the same value (i.e. '0' or '1') for a pre-determined number (e.g. two) of successive trains before responding to the function demand control signal in order to mitigate sensitivity to electrical noise, transients and mis-synchronization. The HVAC equipment 910 activates an associated function (e.g. heating, cooling) responsive to each low-voltage function control signal that is asserted. The ground wire adaptor 200 embodiment of FIG. 4 provides for an environmental control 250 having support for control of N separate HVAC equipment functions to be connected to a two wire voltage supply (i.e. the transformer) and to an N input HVAC equipment 910 using only two wires.

In the above description, reference has been made to negative half-cycles. It will be understood that by configuring the half-wave rectifier and voltage sensing accordingly (e.g. reversing the polarities of half-wave rectifier 954 and diode 222), positive half-waves can be substitutes for the negative half-cycles in the above described embodiments while maintaining the features and functionality of the ground wire adaptor 200.

It will be apparent to one skilled in the art that numerous modifications and departures from the specific embodiments described herein may be made without departing from the spirit and scope of the present invention.

The invention claimed is:

1. A ground wire adaptor for connecting an environmental control, having a power terminal, a ground terminal, a control output terminal and a conductive element connected between the ground terminal and the control output terminal, to a heating/ventilating/air-conditioning (HVAC) equipment, having a first transformer output terminal, a second transformer output terminal and a control input terminal, via a two wire conductor, having a first wire and a second wire, the ground wire adaptor comprising:

a first transformer input terminal connected to the first transformer output terminal for receiving a low-voltage alternating current and connected to the power terminal via the first wire;

a second transformer input terminal connected to the second transformer output terminal for providing a ground return path;

an EC terminal connected to the ground terminal via the second wire for providing a ground path;

an asymmetrically-resistive electrical network connected between the EC terminal and the second transformer input terminal, providing a relatively lower resistance to current flow from the EC terminal to the second transformer input terminal and a relatively higher resistance to current flow from the second transformer input terminal to the EC terminal, for providing ground path continuity;

a HE terminal connected to the control input terminal for providing a control signal;

a control logic unit for sensing voltage on the EC terminal and responsive to detecting a negative half-cycle providing a control signal;

a switching device for connecting, responsive to the control signal from the control logic unit, the first transformer terminal to the HE terminal to provide the control signal to the HVAC equipment;

wherein a low-voltage alternating current half-cycle control signal is provided at the control output terminal of the environmental control when a function is being demanded and further wherein responsive to a control signal at the control input terminal, the HVAC equipment provides the demanded function.

2. The ground wire adaptor of claim 1, wherein references to negative half-cycles are replaced with positive half-cycles and wherein the asymmetrically-resistive electrical network instead providing a relatively higher resistance to current flow from the EC terminal to the second transformer input terminal and a relatively lower resistance to current flow from the second transformer input terminal to the EC terminal.

3. A ground wire adaptor for providing a plurality of control signals to a heating/ventilating/air-conditioning (HVAC) equipment, having a first transformer output terminal, a second transformer output terminal and a plurality of control input terminals, and for connecting to both ends of a two wire conductor, having a first wire and a second wire, connecting a first location and a second location, the ground wire adaptor comprising:

a multi-function environmental control, at the first location, having:

a power terminal connected to the first wire for receiving a low-voltage alternating current;

an output terminal connected to the second wire for establishing a ground reference for the multi-function environmental control;

a control logic unit for continuously generating a control bit stream having repeated frames of N+1 bits, a first synchronizing bit of each successive frame alternating between values '0' and '1', each of the subsequent N bits in each frame taking on a value '1' when a corresponding HVAC equipment function is being demanded and taking on a valve '0' when the corresponding HVAC equipment function is not being demanded; and a switching device connected between the power terminal and the output terminal for receiving the control bit stream and responsive to each bit in the bit stream operating into a non-conductive mode when the bit has value '0' and operating into a conductive mode when the bit has value '1' thereby generating a control signal at the output terminal; and an adaptor module, at the second location, having:

a first transformer input terminal connected to the first transformer output terminal for receiving a low-voltage alternating current and connected to the power terminal via the first wire;

a second transformer input terminal connected to the second transformer output terminal for providing a ground return path;

a EC terminal connected to the output terminal via the second wire for providing a ground path and for receiving the control signal;

an asymmetrically-resistive electrical network connected between the EC terminal and the second transformer input terminal, providing a relatively lower resistance to current flow from the EC terminal to the second transformer input terminal and a relatively higher resistance to current flow from the second transformer input terminal to the EC terminal, for providing ground path continuity;

a plurality of HE terminals, each connected to a corresponding control input terminals;

a plurality of switching devices each one for connecting the first transformer terminal to a corresponding HE terminal responsive to a function control signal;

a control logic unit for sensing voltage on the EC terminal and for:

detecting the presence or absence of negative half-cycles and associating a '0' value with the absence of a negative half-cycle and associating a '1' value with the presence of a negative half-cycle;

detecting successive frames by identifying the synchronizing bit and associating each of the subsequent N bits in each frame with a corresponding function control signal;

asserting a function control signal to each of the switching devices to enter a conductive mode of operation when the corresponding function control signal has value '1'; and de-asserting the function control signal to each of the switching devices to enter the conductive mode of operation when the corresponding function control signal has value '0';

wherein a function control signal is provided at each of the HE terminals of the adaptor module when a corresponding function is being demanded and wherein, responsive to the function control signal at the corresponding control input terminal, the HVAC equipment provides the demanded corresponding function.

4. The ground wire adaptor of claim 3, wherein references to negative half-cycles are replaced with positive half-cycles and wherein the asymmetrically-resistive electrical network instead providing a relatively higher resistance to current flow from the EC terminal to the second transformer input terminal and a relatively lower resistance to current flow from the second transformer input terminal to the EC terminal.

5. The ground wire adaptor of claim 3, the control logic unit further asserting and de-asserting the function control signal to each of the switching devices responsive to the corresponding function control signal having the same value for at least a pre-determined number of successive frames.

* * * * *